US008922310B2

(12) United States Patent
Weber et al.

(10) Patent No.: US 8,922,310 B2
(45) Date of Patent: Dec. 30, 2014

(54) HEAT EXCHANGER SYSTEM FOR DRY-TYPE TRANSFORMERS

(75) Inventors: Benjamin Weber, Winterberg (DE); Bruno Agostini, Dietikon (CH); Jens Tepper, Brilon (DE); Marcos Bockholt, Paderborn (DE); Stephane Schaal, Sierentz (FR)

(73) Assignee: ABB Technology AG, Zurich (CH)

( * ) Notice: Subject to any disclaimer, the term of this patent is extended or adjusted under 35 U.S.C. 154(b) by 121 days.

(21) Appl. No.: 13/479,857

(22) Filed: May 24, 2012

(65) Prior Publication Data

US 2012/0274430 A1 Nov. 1, 2012

Related U.S. Application Data

(63) Continuation of application No. PCT/EP2010/006767, filed on Nov. 6, 2010.

(30) Foreign Application Priority Data

Dec. 8, 2009 (EP) ..... 09015185

(51) Int. Cl.
*H01F 27/10* (2006.01)

(52) U.S. Cl.
USPC ..... 336/57

(58) Field of Classification Search
USPC ..... 336/55–67
See application file for complete search history.

(56) References Cited

U.S. PATENT DOCUMENTS

| | | | | |
|---|---|---|---|---|
| 2,990,443 | A * | 6/1961 | Camilli | 174/15.1 |
| 3,371,298 | A * | 2/1968 | Paul Narbut | 336/57 |
| 4,145,679 | A | 3/1979 | Mitchell | |
| 4,321,421 | A * | 3/1982 | Pierce | 174/11 R |
| 4,523,171 | A | 6/1985 | Altmann et al. | |
| 4,745,677 | A | 5/1988 | Shichi | |
| 5,656,984 | A | 8/1997 | Paradis et al. | |
| 6,838,968 | B2 * | 1/2005 | Nick et al. | 336/57 |
| 7,122,075 | B2 * | 10/2006 | Altmann | 96/173 |
| 2002/0014324 | A1 | 2/2002 | DiPaolo | |

FOREIGN PATENT DOCUMENTS

| | | | |
|---|---|---|---|
| DE | 41 08 981 | A1 | 10/1992 |
| FR | 2 541 552 | A1 | 8/1984 |
| WO | WO 2006/016377 | A1 | 2/2006 |

OTHER PUBLICATIONS

International Search Report (PCT/ISA/210) Issued on Jan. 25, 2011, by the European Patent Office as the International Searching Authority for International Application No. PCT/EP2010/006767.

* cited by examiner

*Primary Examiner* — Tuyen Nguyen
(74) *Attorney, Agent, or Firm* — Buchanan Ingersoll & Rooney PC

(57) ABSTRACT

Exemplary embodiments are directed to a heat exchanger system for transformers or reactors having at least one coil being cooled by gaseous fluids circulating around the transformer. The system having an enclosure that houses the transformer and the at least one coil, where flow of cooling gaseous fluid passes over the coil and is heated by the heat of the transformer or reactor the heated gas is directed to pass over a thermosiphon heat exchanger which dissipates the heat to a cooling media.

20 Claims, 1 Drawing Sheet

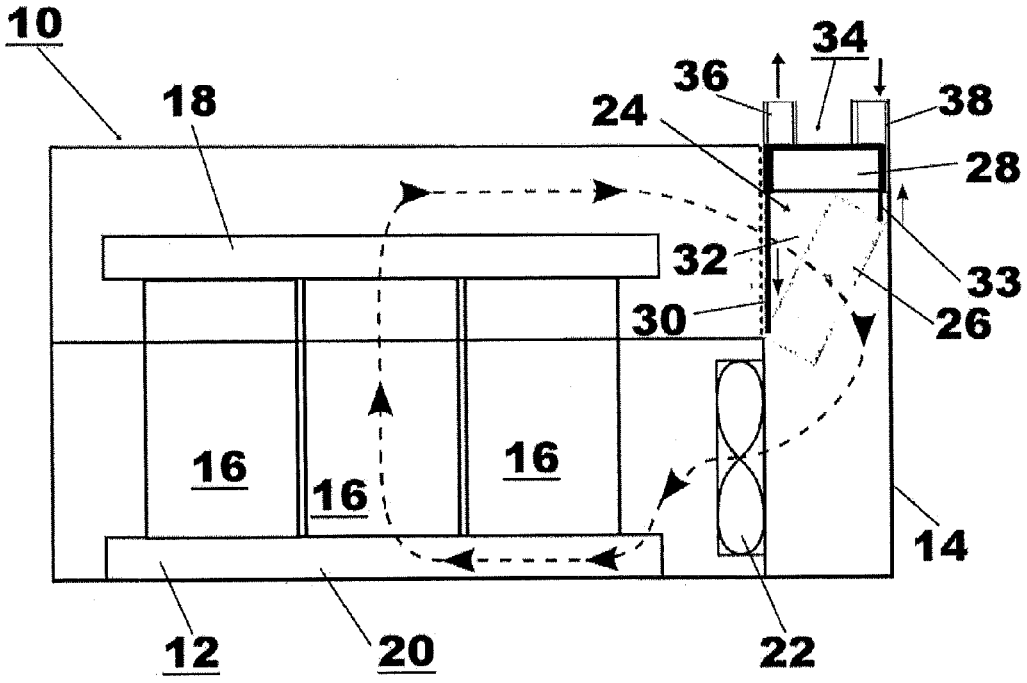
10
18
24
36
34
38
28
32
33
30
26
16
16
16
14
12
20
22

HEAT EXCHANGER SYSTEM FOR DRY-TYPE TRANSFORMERS

RELATED APPLICATIONS

This application claims priority under 35 U.S.C. §120 to International Application No. PCT/EP2010/006767 filed on Nov. 6, 2010 designating the U.S., which claims priority to European Patent Application No. 09015185.3 filed in Europe on Dec. 8, 2009, the entire content of which are hereby incorporated by reference in their entireties.

FIELD

The disclosure relates to transformers, such as, a heat exchanger system for transformers or reactors having at least one coil being cooled by gaseous fluids circulating around.

BACKGROUND INFORMATION

Transformers or any other electromagnetic apparatuses which dissipate heat during operation should be cooled by means of a coolant which absorbs the heat resulting from losses and transfers the heat to a heat sink. Such coolant may be liquid fluids, e.g. oil in case of oil transformers, or gaseous fluids, e.g. gas in case of dry-type transformers.

Known dry type transformers have generally been constructed using one of three types of techniques: conventional dry, resin encapsulated, or solid cast. The conventional dry method uses some form of vacuum impregnation with a solvent type varnish on a completed assembly including the core and the coils or individual primary and secondary coils. A known problem with these types of transformers is the removal of heat generated by power dissipation in the windings.

U.S. Pat. No. 5,656,984 A discloses a solid insulation transformer is known which has a rectangular core covered with a compressible closed-cell foam to eliminate stress during curing of the cast dielectric material surrounding the core and during operation. Heat pipes are placed between the inner coil and the core to extract heat before the temperature builds up. For safety and to eliminate the need for a separate enclosure, an outer multi-layer casing having an incorporated grounded conductive layer is provided to cover the sides of the cast body. The outer casing prevents explosion if dielectric break down and arcing occur, and reduces the danger of electric shock. There are no additional known provisions for cooling the transformer.

In EP 1787304 A1 a compact dry transformer is disclosed which includes a magnetic material core provided with a first heat sink consisting of covers having cooling fins on the outer surface thereof. The transformer also has a coil assembly provided with a second heat sink that includes enclosures having cooling fins on the outer surface thereof. The second heat sink further includes jackets with heat pipes containing a thermo fluid having low boiling point at vacuum such as water. The heat pipes consist of evaporator portions and condenser portions having cooling fins on the outer surface thereof. Due to the heat sinks, heat dissipation efficiency of the transformer is improved.

These known methods and arrangements for heat removal are either affiliated with great efforts for installment of heat pipes and the like or it is rather inefficient as to the amount of removed heat.

SUMMARY

A heat exchanger system for transformers or reactors having at least one coil being cooled by circulating gaseous fluids is disclosed. The heat exchanger system comprising: an enclosure housing the transformer; a thermosiphon heat exchanger; and cooling media, wherein a cooling fluid flowing around the coil and is heated by the heat of the transformer or reactor and passes over the thermosiphon heat exchanger, which dissipates the heat to a cooling media.

A heat exchanger system for a dry-type transformer having at least one coil, a core formed of laminated sheet packages, windings encased in epoxy resin and wound around the core, a yoke, and a fan that supports circulation of cooling gas is disclosed. The heat exchanger system comprising: a container that houses the transformer; and a gas-to-water thermosiphon heat exchanger, wherein the cooling gas is heated by flowing around the coils of the transformer, and the heated gas is directed to pass over the gas-to-water thermosiphon heat exchanger which is connected to an external water circulation system.

BRIEF DESCRIPTION OF THE DRAWINGS

In the following, the disclosure will be described in greater detail by means of exemplary embodiments and with reference to the attached drawings, in which:

FIG. 1 shows a schematic view in side elevation of an arrangement of a dry-type transformer in accordance with an exemplary embodiment.

DETAILED DESCRIPTION

Exemplary embodiments of the present disclosure are directed to allowing a totally enclosed dry transformer to be cooled by gas more efficient than known systems while also reducing the efforts with the construction of such exemplary transformers accomplishing this goal and achieving the desired heat reduction.

According to exemplary embodiments of the present disclosure an entire transformer is disposed within a container designed as an air tight enclosure wherein a flow of cooling gas passes over (e.g., flows around) the coils and the gas heated by the heat of the transformer can be directed to pass over a gas-to-water thermosiphon heat exchanger being thermally connected to an external water circulation.

Inside the transformer, gaseous fluid can flow as a coolant that dissipates its received heat to an intermediate dielectric fluid. The intermediate dielectric fluid, which can be contained in a closed loop, transfers its heat to cooling water outside the transformer to carry away the heat taken from the intermediate dielectric fluid. This intermediate fluid circulates naturally with gravity, evaporates inside the enclosure in a gas evaporator, and condenses in a water condenser. As a result, a gas-to-water heat exchanger can be formed with an arbitrary distance between the hot gas and the cold water due to the transport of heat by way of the phase change of the dielectric fluid. The exemplary embodiment as disclosed forms a gas-to-water thermosiphon.

According to an exemplary embodiment of the disclosure the evaporator heat exchanger can be arranged within the container and the water condenser is located outside of the container.

In addition, a fan can be provided for supporting the flow of gas through the transformer. Ducts can be arranged within the container to direct the gas flow to the coils at their lower end in order to make use of fluid physics, where due to gravity cool gas is heavier than heated gas which rises.

According to exemplary embodiments disclosed herein, the evaporator heat exchanger and the condenser heat exchanger establish a gas to water thermosiphon. A thermosiphon uses the method of passive heat exchange based on natural convection which circulates liquid in a closed loop without the necessity of a mechanical pump. To this end, the so-called thermosiphon principle can be used where an intermediate fluid evaporating at the gas side and condensing at the water side circulates naturally by gravity. Its intended purpose is to simplify the transport of liquid as a heat-carrier and/or heat transfer, by avoiding the cost and complexity of a conventional liquid pump.

According to another exemplary embodiment of the present disclosure, the gas-to-water heat exchanger is made of an extremely good heat transferring material, e.g. aluminum or copper, having a thermal conductivity of $\alpha$>150 W/mK, for example. Hence, an automotive type aluminum heat exchanger can be employed and used on the gas side inside the container.

Advantageously, known systems use of a special alloy for the gas-to-water heat exchanger on its water side is significantly reduced or not specified by the exemplary embodiments disclosed herein, because optimized water, e.g. ultrapure water which is usually deionized in order to prevent the respective components from corrosion and the like, is used.

Accordingly as an appropriate material for the waterside of the thermosiphon heat exchanger, exemplary embodiments of the present disclosure can use a cupro-nickel alloy, such that all surfaces of the system that come in contact with water are plated with the cupro-nickel alloy. In some cases, e.g. if in an exemplary embodiment sea water is used, corrugated plate condensers can be made from titanium.

To improve or optimize the thermal flux from the heated gas to the heat exchanger, an exemplary heat exchanger can be provided with fins which interact with the gas to improve the heat transfer by convection.

According to an exemplary embodiment, of the disclosure the measures for optimization of the gas side and the water side are taken separately. In this system, an intermediate phase change fluid is used, and the heat is transferred to the water by condensation, e.g. by using a plate type heat exchanger. Since the heat capacity on the water and condensing sides are similar exemplary heat exchangers disclosed herein can be more compact than known heat exchangers. For example, the compact heat exchanger according to exemplary embodiments of the present disclosure has a weight of about 29 kg for 97 kW of heat duty which results in less need of alloy by about 69%. On the evaporation side, where a large heat transfer area is needed due to the poor heat capacity of gas, a standard technology can be used such as automotive type heat exchangers made from aluminum. When clean internal gas and clean dielectric fluid only are in contact with this heat exchanger, no specific and expensive alloy is needed.

Finally an exemplary embodiment of the disclosure is based on using a thermosiphon gas-to-water heat exchanger in a dry transformer in the way in order to transfer the heat from the enclosure, where the transformer is positioned and then cooled by clean gas, to tap water. The use of a thermosiphon has the following advantages:

Improved reliability since there is not any water running inside the transformer. In the event of a leak, only dielectric fluid will be discharged. The separation of gas and water sides allows better optimizing of each side. Consequently the use of special alloy on the water side can be significantly reduced, e.g. by about 69%, because the water condenser is optimized for water.

Likewise the utilization of customary automotive type aluminum heat exchanger can reduce the efforts for development and construction of specific heat exchangers to be used on the gas side inside the transformer.

Because the design of the system is flexible, the condenser can be positioned anywhere, as far as it is above the evaporator which position is needed for the gravity driven natural circulation of the intermediate fluid.

FIG. 1 shows a schematic view in side elevation of an arrangement of a dry-type transformer in accordance with an exemplary embodiment. In particular, FIG. 1 shows a schematic view in side elevation of an arrangement of a transformer 10 according to the disclosure, where a dry-type transformer 12 is arranged in a container 14.

The dry-type transformer 12 includes three coils 16 which are encompassed by an upper yoke 18 and a lower yoke 20 wherein each coil 16 is attached to a core (not shown) that is attached to the yokes 18, 20 in order to close the magnetic circuit. Each coil includes (e.g., consists of) at least two windings which are encased in epoxy resin.

The dry-type transformer 14, is cooled by a cooling gas that is circulated while being encapsulated in the container 14. Additionally this gas flow—shown by a dashed line with large arrows—is supported by a fan 22 which blows the cooling gas from below against the dry-type transformer 12.

The fan 22 is arranged at a wall which separates the space wherein the dry-type transformer 12 is positioned from a compartment in which a thermosiphon 24 is located. This thermosiphon 24 has a vaporizer 26 and a condenser 28, which is positioned above the vaporizer 26 due to flow-physics and gravity. The connection between the vaporizer 26 and the condenser 28 is established on one side by a liquid downcomer 30 and on the other side by the vapor riser 33. Hence, the thermosiphon 24 includes (e.g., consists of) the vaporizer 26, the condenser 28, the liquid downcomer 30, and the vapor riser 33 and forms a closed loop accordingly.

As shown in FIG. 1, cooling gas passes over the coils 16 and receives the heat generated therein, and flows to the upper region of the dry-type transformer 12 where the gas flux passes over the vaporizer 26 which advantageously can be a customary automotive heat exchanger.

As for the gas, it is all the same since the enclosure 14 is provided to be gas tight wherein the circulation of gas is supported by the fan 22 takes place. As for the water, there is one circuit of flow, an open circuit which is not shown in detail but indicated by two pipe ends 36 and 38 respectively by arrows for outflow and inflow.

As for the circulation of the gas after leaving the dry-type transformer 12 enriched with heat the gas passes through the vaporizer 26 and transfers its affiliated heat to the vaporizer 26 respectively to the intermediate fluid flowing in the closed loop 32. After having passed through the vaporizer 26, the intermediate fluid vaporized by the affiliated heat from the gas flows towards the condenser 28 through the vapor riser 33.

Subsequently it flows through the pipe 33 belonging to the closed loop 32 to the condenser 28 which actually is a heat exchanger, too. In the condenser 28, the vaporized intermediate fluid is condensed by dissipating its heat to the fluid of the open circle 34 which is usually water, e.g. tap water.

After condensation of the intermediate fluid it reaches the liquid downcomer 30 again and the cooling procedure restarts.

As a media for the intermediate fluid of the closed loop, e.g., Halocarbon compounds or the like, are provided which change the physical condition due to thermal impact e.g. from liquid phase to gaseous phase and reverse.

Thus, it will be appreciated by those skilled in the art that the present invention can be embodied in other specific forms without departing from the spirit or essential characteristics thereof. The presently disclosed embodiments are therefore considered in all respects to be illustrative and not restricted.

The scope of the invention is indicated by the appended claims rather than the foregoing description and all changes that come within the meaning and range and equivalence thereof are intended to be embraced therein.

LIST OF REFERENCES

10 transformer
12 dry-type transformer
14 Container, enclosure
16 coil
18 upper yoke
20 lower yoke
22 fan
24 thermosiphon
26 vaporizer
28 condenser
30 liquid downcomer
32 closed loop
33 vapor riser
34 open circuit
36 outflow pipe
38 influx pipe

What is claimed is:

1. A heat exchanger system for transformers having at least one coil being cooled by circulating gaseous fluids, comprising:

an enclosure housing the transformer;

a thermosiphon heat exchanger; and a fan disposed between the thermosiphon heat exchanger and the transformer is configured to blow the cooling fluid through a first closed loop arrangement against the transformer, wherein a cooling fluid within the enclosure and flowing around the coil is heated by the transformer in the first closed loop and passes over the thermosiphon heat exchanger, which dissipates the heat to an intermediate cooling fluid flowing in the thermosiphon heat exchanger of a second closed loop.

2. The system according to claim 1, where the thermosiphon heat exchanger is arranged within the second closed loop comprising an evaporator heat exchanger connected to a condenser.

3. The system according to claim 1, wherein said thermosiphon heat exchanger comprises an air heat exchanger which is provided as an evaporator.

4. The system according to claim 3, wherein said thermosiphon heat exchanger comprises a water heat exchanger which is provided as a condenser.

5. The system according to claim 4, wherein the condenser is located within the enclosure.

6. The system according to claim 3, wherein the evaporator and the condenser are linked together by a first tube and a second tube to form a thermosiphon, and wherein the first tube is a liquid downcomer and the second tube is a vapor riser.

7. The system according to claim 3, where the evaporator heat exchanger is made of aluminum or copper.

8. The system according to claim 1, wherein an automotive type aluminum heat exchanger is used inside the enclosure.

9. The system according to claim 1, wherein the cooling fluid is a liquid coolant optimized against corrosion such that an amount of alloy used on a liquid coolant side of the condenser heat exchanger is reduced.

10. The system according to claim 9, wherein an intermediate fluid inside the heat exchanger is a dielectric fluid.

11. The system according to claim 4, wherein the condenser side of the thermosiphon heat exchanger is made of a cupro-nickel alloy.

12. The system according to claim 10, wherein all surfaces of the system that come in contact with water are plated with cupro-nickel alloy or titanium.

13. The system according to claim 1, wherein a heat exchanger includes fins that interact with the cooling gas to improve the heat transfer by convection.

14. A heat exchanger system according to claim 1, wherein the transformer is a dry-type transformer having windings encased in epoxy resin and wound around a core, wherein the transformer includes a core formed of laminated sheet packages, a yoke, and a fan that supports circulation of cooling gas, wherein the entire transformer is disposed within a container, and wherein the cooling gas is heated by flowing around the coils of the transformer, and the heated gas is directed to pass over a gas-to-water thermosiphon heat exchanger which is connected to an external water circulation system.

15. The system according to claim 1, wherein the evaporator heat exchanger is arranged within the enclosure while the water condenser is located outside of the enclosure.

16. The system according to claim 1, wherein a fan is provided for making the gas flow through the transformer.

17. The system according to claim 2, wherein an automotive type aluminum heat exchanger is used inside the enclosure.

18. The system according to claim 2, wherein the cooling fluid is a liquid coolant optimized against corrosion such that an amount of alloy used on a liquid coolant side of the condenser heat exchanger is reduced.

19. The system according to claim 5, wherein the evaporator and the condenser are linked together by a first tube and a second tube to form a thermo-siphon, and wherein the first tube is a liquid downcomer and the second tube is a vapor riser.

20. A heat exchanger system for a dry-type transformer having at least one coil, a core formed of laminated sheet packages, windings encased in epoxy resin and wound around the core, a yoke, and a fan that supports circulation of cooling gas, the system comprising:

a container that houses the transformer;

a gas-to-water thermosiphon heat exchanger; and a fan disposed between the thermosiphon heat exchanger and the transformer is configured to blow the cooling gas within the container through a first closed loop arrangement against the dry-type transformer, wherein the cooling gas is heated by flowing around the coils of the transformer in the first closed loop, and the heated gas is directed to pass over the gas-to-water thermosiphon heat exchanger which is connected to an external water circulation system and dissipates the heat to an intermediate cooling fluid flowing in the thermosiphon heat exchanger of a second closed loop.

* * * * *